US012410665B2

(12) United States Patent
Lindblom et al.

(10) Patent No.: US 12,410,665 B2
(45) Date of Patent: Sep. 9, 2025

(54) WEAR SUPPORT ASSEMBLIES FOR RAISE BORING TOOLS

(71) Applicant: SANDVIK MINING AND CONSTRUCTION TOOLS AB, Sandviken (SE)

(72) Inventors: Anders Lindblom, Sandviken (SE); Joona Loikkanen, Sandviken (SE)

(73) Assignee: Sandvik Mining and Construction Tools AB, Sandviken (SE)

( * ) Notice: Subject to any disclaimer, the term of this patent is extended or adjusted under 35 U.S.C. 154(b) by 0 days.

(21) Appl. No.: 17/927,927

(22) PCT Filed: May 24, 2021

(86) PCT No.: PCT/EP2021/063760
§ 371 (c)(1),
(2) Date: Nov. 28, 2022

(87) PCT Pub. No.: WO2021/239664
PCT Pub. Date: Dec. 2, 2021

(65) Prior Publication Data

US 2023/0212916 A1 Jul. 6, 2023

(30) Foreign Application Priority Data

May 29, 2020 (EP) ..... 20177329

(51) Int. Cl.
*E21B 17/10* (2006.01)
*E21B 10/28* (2006.01)
(Continued)

(52) U.S. Cl.
CPC ..... *E21B 17/1085* (2013.01); *E21B 10/28* (2013.01); *E21B 10/50* (2013.01); *E21B 7/28* (2013.01)

(58) Field of Classification Search
CPC ..... E21B 17/1085; E21B 10/28; E21B 10/50; E21B 7/28
See application file for complete search history.

(56) References Cited

U.S. PATENT DOCUMENTS 4,069,878 A * 1/1978 Chitwood ..... F16D 1/092 175/320
6,116,357 A * 9/2000 Wagoner ..... E21B 10/24 175/401

(Continued)

FOREIGN PATENT DOCUMENTS

DE 29609140 U1 8/1996
WO 2016200832 A1 12/2016

*Primary Examiner* — Taras P Bemko
(74) *Attorney, Agent, or Firm* — Corinne R. Gorski

(57) ABSTRACT

A wear support assembly includes a wear pad arranged on top of a support plate, wherein the support plate has a lower surface for connecting to a raise boring tool and both the wear pad and the support plate have at least one hole for receiving a bolt to connect the wear pad to the support plate. Also, a raise boring tool for raise boring operations includes a reamer head having a body, a plurality of roller cutters connected to the body using a holder, a nose or drive stem connected the body, and at least one wear support assembly, wherein each support plate is connected directly to the raise boring tool and each wear pad is radially or perpendicularly bolted to each support plate.

15 Claims, 10 Drawing Sheets

(51) Int. Cl.
*E21B 10/50* (2006.01)
*E21B 7/28* (2006.01)

(56) References Cited

U.S. PATENT DOCUMENTS

| | | | | |
|---|---|---|---|---|
| 6,296,067 | B1 * | 10/2001 | Slaughter, Jr. | E21B 10/24 384/93 |
| 2009/0166093 | A1 | 7/2009 | Pessier et al. | |
| 2010/0126778 | A1 * | 5/2010 | Osborne, Jr. | E21B 7/28 175/361 |
| 2011/0079440 | A1 | 4/2011 | Buske et al. | |
| 2011/0079441 | A1 * | 4/2011 | Buske | E21B 10/28 175/336 |
| 2016/0130887 | A1 | 5/2016 | Barnes et al. | |
| 2018/0229467 | A1 * | 8/2018 | Walker | E21B 4/003 |

* cited by examiner

WEAR SUPPORT ASSEMBLIES FOR RAISE BORING TOOLS

RELATED APPLICATION DATA

This application is a § 371 National Stage Application of PCT International Application No. PCT/EP2021/063760 filed May 24, 2021 with priority to EP 20177329.8 filed May 29, 2020.

TECHNICAL FIELD

The present invention relates to wear support assemblies for raise boring tools, especially to wear support assemblies for reamer heads and drive stems.

BACKGROUND

Raise boring tools have a reamer head that is used for drilling a raise by reaming a pilot hole to the desired final diameter. Reamer heads are usually composed of a number of rolling cutters which are arranged in an annular pattern on a body and are rotated at the same time as the reamer head is fed upwardly, thus disintegrating the rock around the pilot hole. During the drilling a drive stem or bull nose is located in the pilot hole. The pilot hole can either be drilled at the same time as drilling the raise (in the case of blind boring) or in advance.

Reamer heads traditionally have wear pads either integrated on or welded on a part or parts of their body to help stabilise the reamer head as it is drilling and protect it from excessive wear in exposed regions. The wear pads are usually made of mild steel with a hard facing applied on the outer, exposed surface. The problem is that when the wear pads need to be replaced the only way to do this is to send the entire reamer head to the workshop to remove the used wear pad and re-weld it back on or weld a new one on, which is time consuming, often taking several days, which is not very convenient.

Therefore, the problem to be solved is how to provide wear pads that can be replaced easily next to the rig, therefore reducing the down time of the drilling operation, whilst still providing effective wear protection and improved stability to the raise boring tool and which are securely held in place so that they are not easily displaced when they are subjected to drilling forces.

SUMMARY

It is an objective of this invention to provide a novel and improved wear pad design for raise boring tools. Specifically, the aim is to provide a wear pad design that can easily be replaced directly by the drilling rig. A further aim is to provide wear pads that improve the stability of the drilling operation and which are securely held in place so that they are not easily removed when forces from the drilling are applied.

This objective is achieved by providing a wear support assembly comprising a wear pad arranged on top of a support plate wherein the support plate has a lower surface for connecting to a raise boring tool and at least one hole for receiving a bolt to connect the wear pad to the support plate. Preferably, the lower surface of the support plate is curved, but it could also be flat. The at least one hole should be present in both the wear pad and the support plate and the holes should be aligned so that a bolt could connect the two parts in radial or perpendicular direction with respect to the lower surface of the wear pad. Advantageously, this design means that the wear pads can easily be replaced next to the rig. The inclusion of the support plates and radial or perpendicular (or vertical) direction of the bolting with respect to the lower surface of the wear pad means that the wear pads are securely held in place, so that as the drilling forces are applied the wear pads are not easily removed. This design also provides increased stability to the reamer head, especially when larger wear pads are fitted, so that wear to the raise boring tool is reduced and its working lifetime is increased.

Preferably, there are more than two holes, preferably four holes. Advantageously, this means more bolts can be used to connect the wear pad to the support plate and therefore the wear pads are more securely held to the support plates as the force from the drilling is spread between more contact points.

Optionally, the holes have two diameters, wherein the larger diameter hole is nearer an upper surface of the support plate and the smaller diameter hole is nearer a lower surface of the support plate. Advantageously, this means the bolts can be countersunk into the wear pad and therefore they are more protected from wear.

Preferably, the wear support assembly further comprises at least one bolt, more preferably than two bolts. Preferably, each wear pad is bolted to each support plate using more than two bolts, such as four bolts, for example one bolt in each corner of the wear pad. The bolts project radially or perpendicularly into the wear support assembly with respect to a lower surface of the wear pad. Advantageously, this means the wear pads are more securely held to the support plates as the force from the drilling is spread between more contact points.

Optionally, the support plate has a stop bolt, preferably this is positioned on its rotationally trailing side when connected to the raise boring tool. Alternatively, the stop bolt could be on the rotationally leading side or on both the rotationally trailing and leading sides. Advantageously, the stop bolt provides further support for the wear pad against the rotational forces from the drilling operation, therefore ensuring that the wear pad remains rigidly in place.

Preferably, the support plate comprises a back end step for securing the wear pad to the support plate. Advantageously, the inclusion of the step on the back end of the support plates ensures that the wear pad is rigidly held to the support plate by providing support against the forces applied from the forward drilling direction.

Optionally, the support plate comprises a side step for securing the wear pad (22) to the support plate, preferably on its rationally trailing side when connected to the raise boring tool. Alternatively, the side step could be positioned on the rotationally leading side of the support plate or on both sides of the support plate. Advantageously, the inclusion of the side step on the support plates ensures that the wear pad is securely held to the support plate by providing support against the forces applied from the rotation of the reamer head.

Optionally, the back end step and/or the side step(s) is/are milled onto the support plate. In other words, the support plate is made of a one piece body. The advantage of this is the strength of the support plate is maintained.

Alternatively, the back end step is bolted or welded onto the support plate. In other words, the support plate is made from two pieces which are connected together. The advantage of this design is that it is easier to replace the step(s) in the field.

Optionally, there is a key located on the support plate. Advantageously, the key relieves the bolts from stress and ensures that the support plate and wear pad are securely held together to therefore reduce the risk that the wear pad is dislodged during the drilling operation.

Optionally, the key is press fit in position. Advantageously, this enables easy construction.

Alternatively, the key is bolted in position. Advantageously, this means the key is securely held in place.

Preferably, the one or more bolts are countersunk into the wear pad. Advantageously, this means the bolts will be less exposed to wear and will therefore last longer.

Optionally, an upper surface on the support plate and a lower surface on the wear pad are both flat. Alternatively, the upper surface on the support plate and the lower surface on the wear pad are both convex. The selection between flat or convex geometry will depend on the manufacturing capabilities and design of the reamer head.

Preferably, the wear pad is hard faced, for example with tungsten carbide. Advantageously, this will increase the wear resistance of the wear pads.

Another aspect of the present invention relates to a raise boring tool for raise boring operations comprising; a reamer head having a body; a plurality of roller cutters connected to the body using a holder; a nose or drive stem connected the body; and at least one wear support assembly; wherein each support plate is connected directly to raise boring tool and each wear pad is bolted to each support plate, preferably in a direction radially or perpendicularly with respect to the lower surface of the wear pad. Advantageously, this design means that the wear pads can easily be replaced next to the rig. The inclusion of the support plates and radial or perpendicular direction of the bolting means that the wear pads are securely held in place, so that as the drilling forces are applied the wear pads are not easily removed. This design also provides increased stability to the reamer head, especially when larger wear pads are fitted, so that wear to the raise boring tool is reduced and its working lifetime is increased.

The body of the reamer head could either have a nose, or be connected to a nose or be connected to a drive stem. If the body of the reamer head has or is connected to a nose, the nose could either have a threaded connection for attaching to a stabilizer pipe or pilot bit or could be a bull nose which forms front end of the reamer head.

In one embodiment, at least one wear support assembly is positioned on the body of the reamer head. Advantageously, this provides wear protection to the body of the reamer head and stability to the drilling operation.

In another embodiment, at least one wear support assembly is positioned on the nose of the reamer head. Advantageously, this provides wear protection to the nose of the reamer head.

In another embodiment, at least one wear support assembly is positioned on the drive stem. Advantageously, this provides wear protection to the drive stem.

The wear support assembly could be positioned on only the body of the reamer head; or on only the nose of the reamer head or the drive stem; or on both the body of the reamer head and the nose of the reamer head or the drive stem.

Optionally, the nose of the reamer head is integrated with the body of the reamer head. Alternatively, the nose is detachable from the body depending on the design of the reamer head.

BRIEF DESCRIPTION OF THE DRAWING

A specific implementation of the present invention will now be described, by way of example only, and with reference to the accompanying drawings.

DETAILED DESCRIPTION

Figure 1:
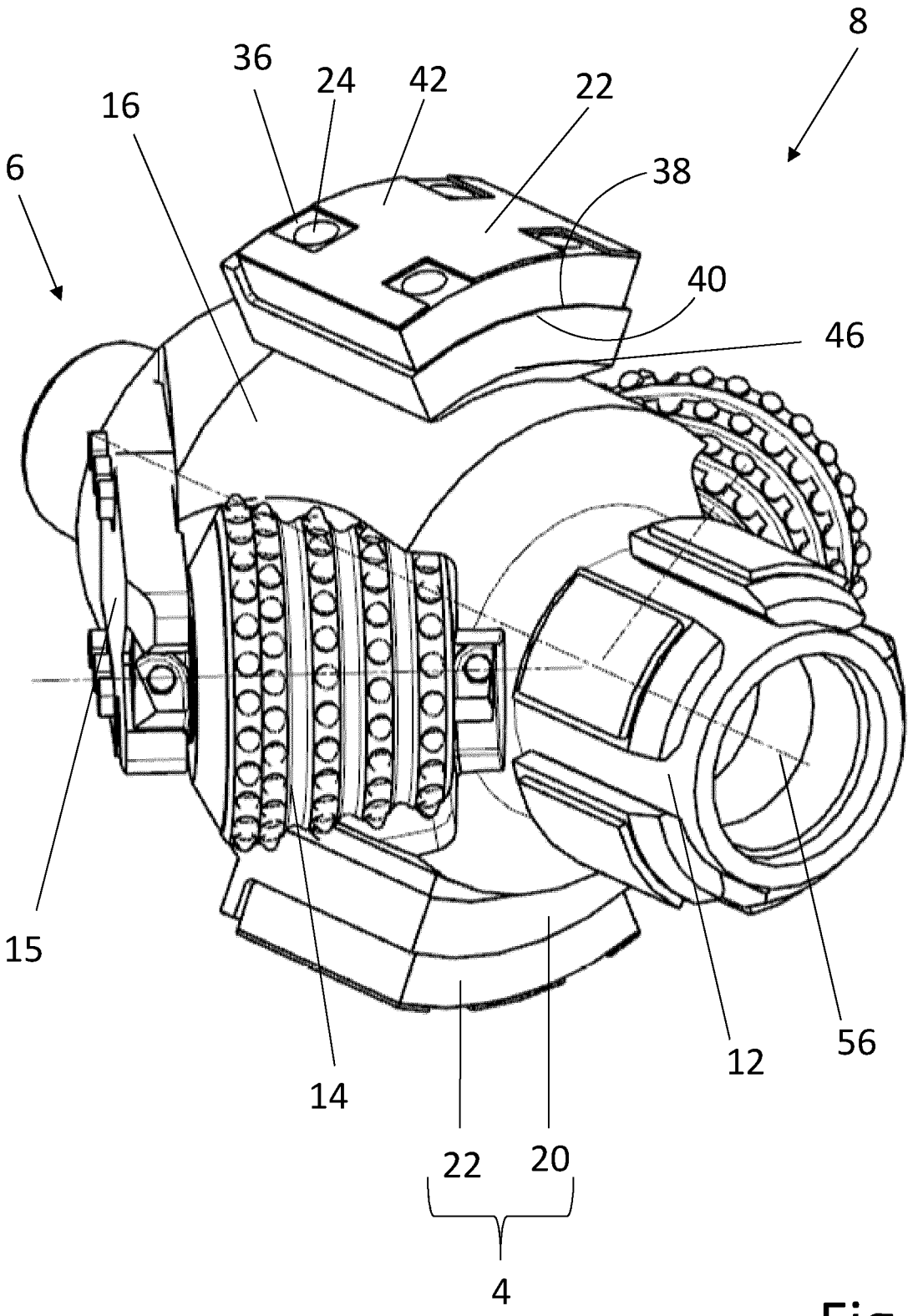
FIG. 1: Perspective view of a raise boring tool having a reamer head with two roller cutters and the wear support assembly positioned on the body of the reamer head.

FIG. 1 shows a raise boring tool 6 having reamer head 8 comprising a body 16 and a plurality of roller cutters 14 which are rotatably mounted on the body 16 using holders 15 (otherwise known as fasteners, tool holders or saddles) and a nose 12 having a threaded connection for attachment to a stabilizer pipe and pilot bit (alternatively a bull nose fitted). The holders 15 are mounted or integrated on the body 16. The nose 12 can either be integrated with the body 16 or a separate attachable part.

Figure 4:
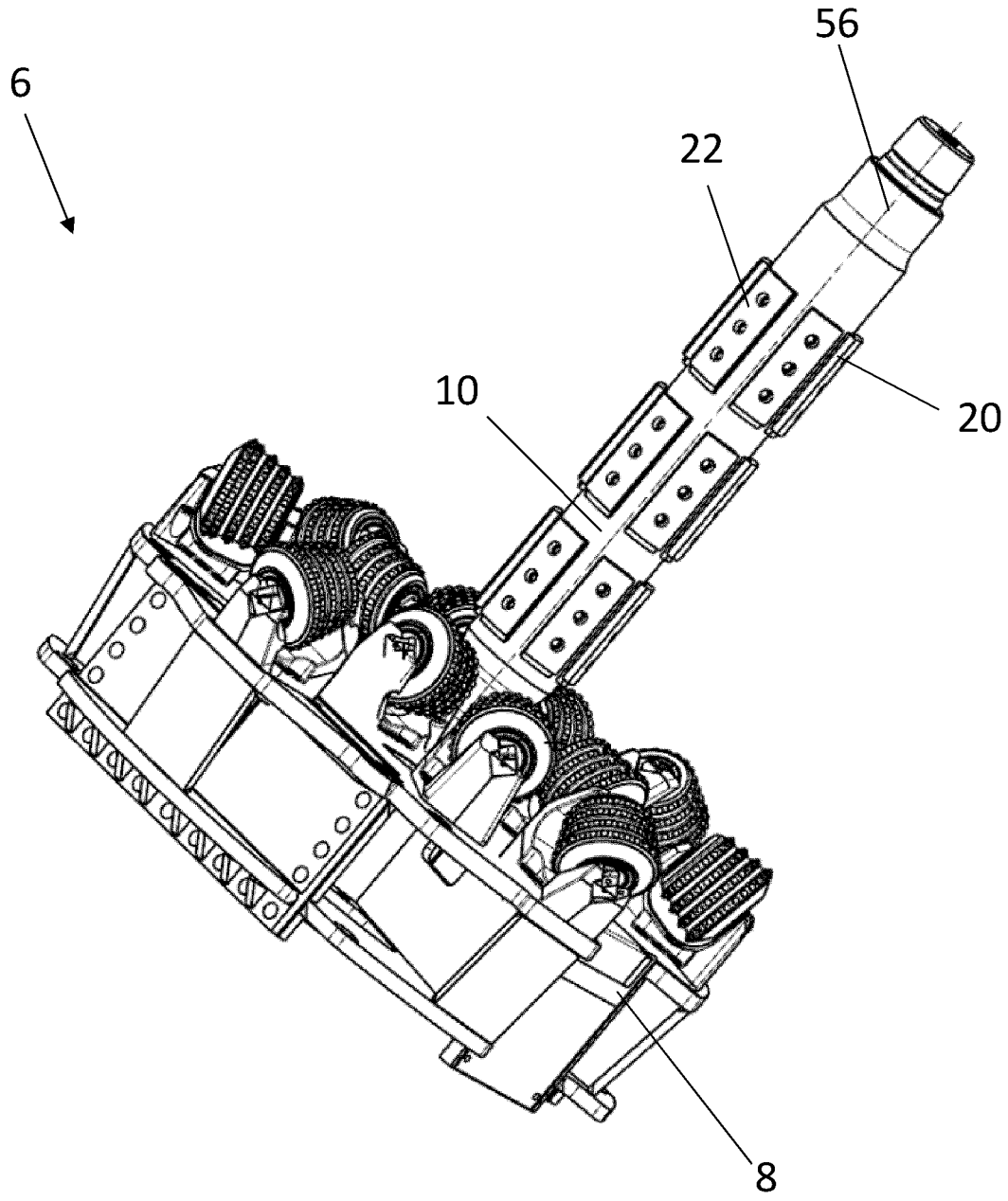
FIG. 4: Perspective view of a raise boring tool having a reamer head connected to a drive stem and the wear support assembly positioned on the drive stem.
Figure 5:
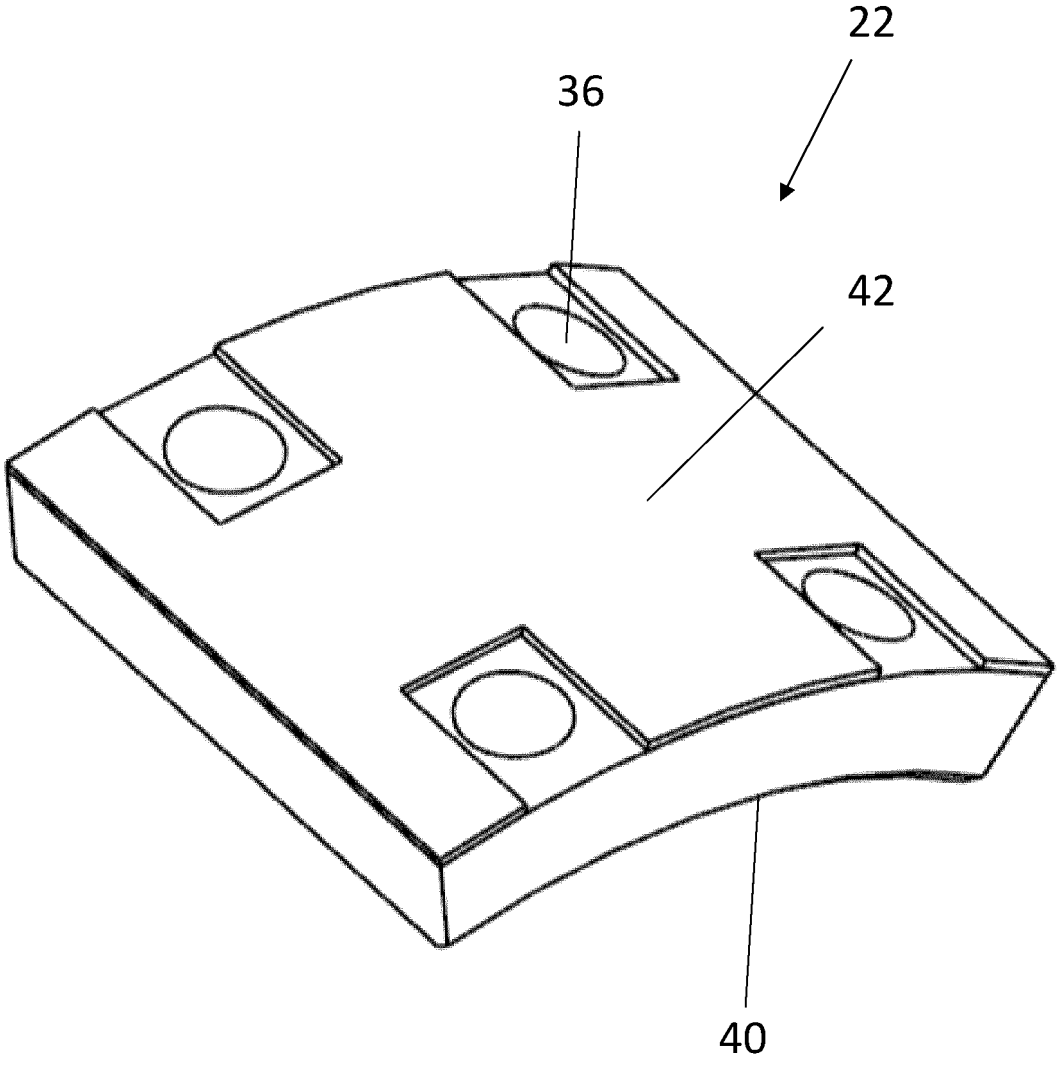
FIG. 5: Perspective view of the wear pad.

The nose 12 may be a bull nose and form the front end of the reamer head 8 or it may have a threadedly connection for attachment to a stabilizer pipe and pilot bit. Alternatively, a drive stem 10 may be attached to the body 16 of the reamer head 8 instead of the nose 12, as shown in FIG. 4.

At least one support plate 20 is attached onto the raise boring tool 6 in a region where wear protection is needed. The support plate 20 has lower surface 46 for connecting radially to a raise boring tool 6, which is preferably curved but could be flat. Radially means perpendicular to a centre line 56 of the raise boring tool 6. Preferably, the support plate 20 is welded onto the raise boring tool 6. Alternatively, the support plate 20 could be bolted or secured in any other suitable way onto the raise boring tool 6. The support plate(s) 20 could be fitted to the body 16 and/or the nose 12 of the reamer head 16 and/or could be fitted to the drive stem 10 or in any other position where wear protection is required. A wear pad 22 is then radially or perpendicularly bolted to the support plate 20 using a plurality of bolts 24 with respect to the lower surface 40 of the wear pad 22. Preferably, more than two bolts 24 are used, such as four bolts 24. For example, there could be one bolt 24 in each of the corners of the wear pad 22. The support plate 20 and the wear pad 22 together form a wear support assembly 4. FIG.

5 shows the wear pad 22 in more detail. Typically, the support plates 20 and wear pads 22 have an oblong shape, but they could be any other suitable shape and have holes 36 drilled into them for receiving the bolts 24. The bolts 24 may extend through the wear pad 22 into the support plate 20 or they may also extend through the support plate 20 into the body 16 or the nose 12 of the reamer head 8 or into the drive stem 10. The wear pads 22 have a lower surface 40, that contacts an upper surface 38 on the support plate, and an upper surface 42, that is exposed to the rock being drilled. The holes 36 project in a direction perpendicular to or radially with respect to the lower surface 40 of the wear pads 22. The wear pads 22 are made from a wear resistant material, for example the wear pads 22 could be made from a mild steel or a hard steel. Preferably, the upper surface 42 of the wear pad is hard faced, for example with tungsten carbide or any other suitable wear resistant material. Alternatively, cemented carbide inserts could be added to the wear pads 22 to increase their wear resistance. Preferably, the bolts 24 are countersunk into the wear pad 22 to reduce their exposure to wear. This can be achieved by drilling holes 36 in the wear pad 22 for receiving the bolts 24 having two diameters, wherein the larger diameter hole is nearer the upper surface 42 and the smaller diameter hole is nearer the lower surface 40. The area of the wear pad 22 can be increased to any suitable size for the specific raise boring tool 6 to provide addition wear protection and stability.

Figure 2:
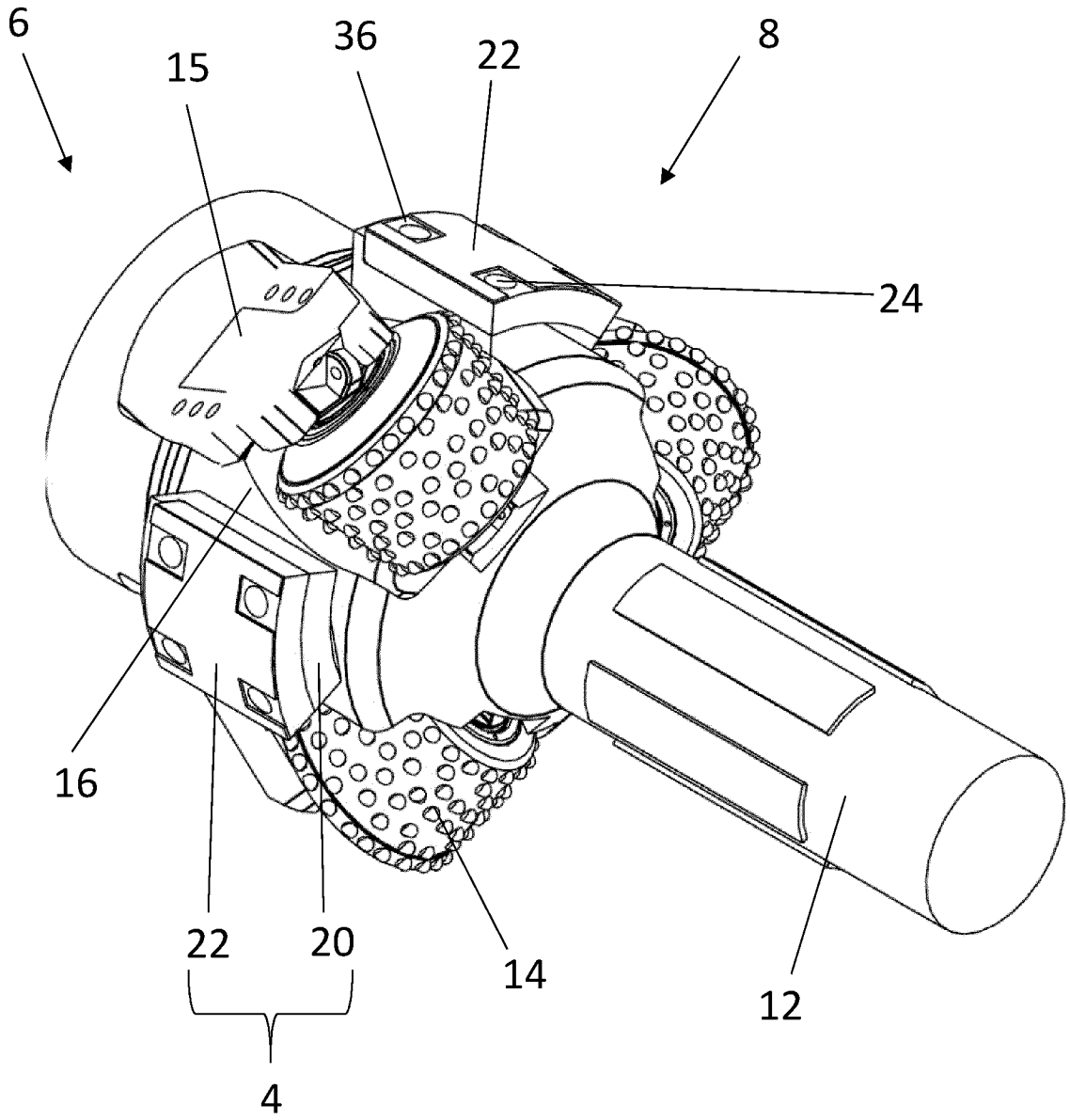
FIG. 2: Perspective view of a raise boring tool having a reamer head with three roller cutters and the wear support assembly positioned on the body of the reamer head.
Figure 3:
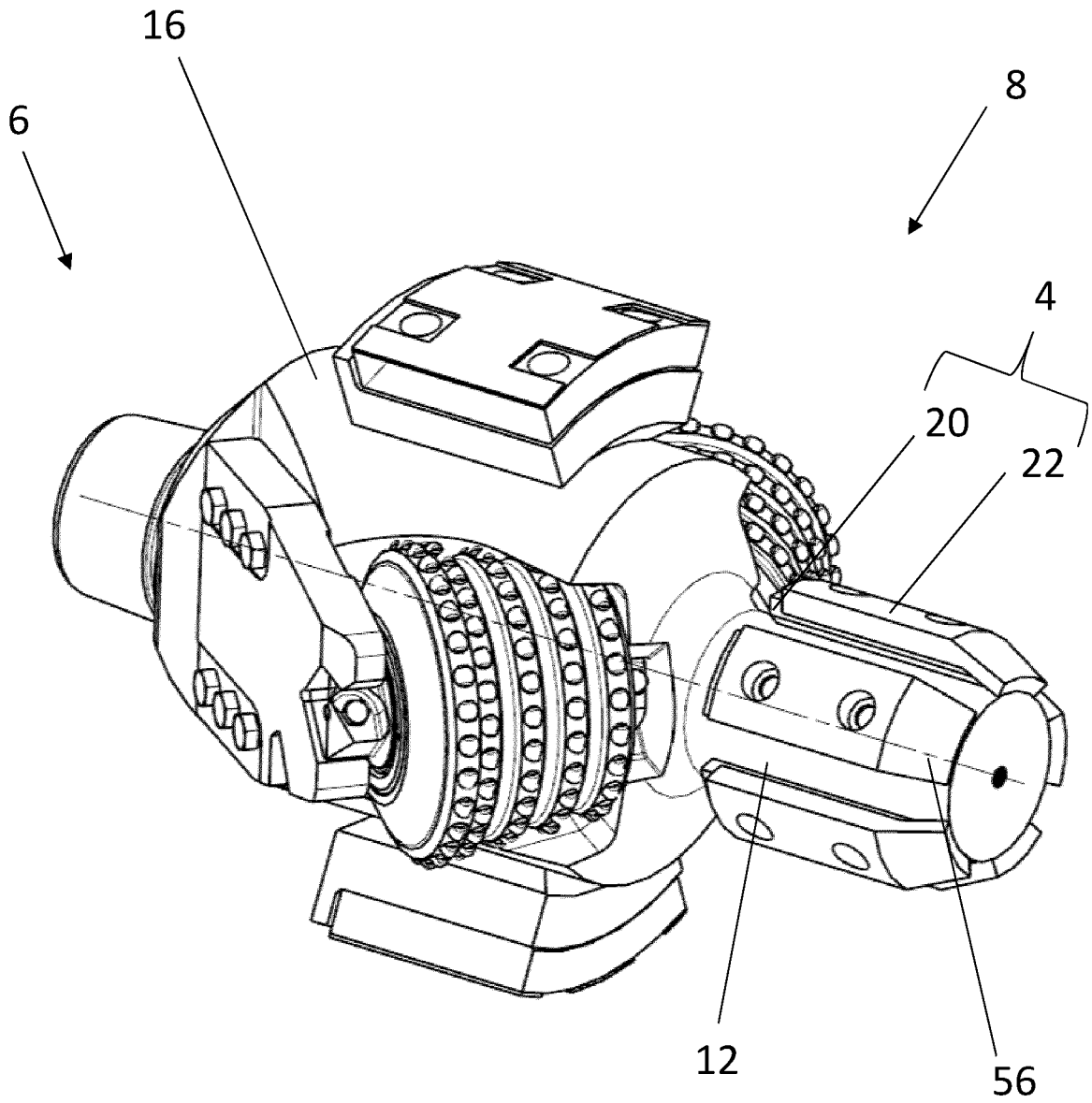
FIG. 3: Perspective view of a raise boring tool having a reamer head with two roller cutters and the wear support assembly positioned on the nose of the reamer head.

The wear support assembly 4 can be attached to any part of the raise boring tool 6 where wear protection is required. FIG. 1 shows an example where the raise boring tool 6 is a slot raiser and where the wear support assemblies 4 are attached to the body 16 of the reamer head 8 that has two roller cutters 14 and a nose 12 with a threaded connection. When there are only two roller cutters 14, the wear support assemblies 4 are particularly important for adding stability to the drilling operation. FIG. 2 shows an example of a slot raiser where the wear support assemblies 4 are attached the body 16 of the reamer head 8 that has three roller cutters 14 and a nose 12 with a threaded connection. FIG. 3 shows an example of a slot raiser that has two rollers cutters 14, the nose 12 is a bull nose and where the wear pads 22 and support plates 20 are attached the nose 12 of the reamer head 8. FIG. 4 shows an example of a raise boring tool 6 wherein the reamer head 8 is attached a drive stem 10 and wherein the wear pads 22 and support plates 20 are attached to the drive stem 10. In this case the drive stem 10 connects the reamer head 8 to a rig (not shown) and assists in stabilising the drilling operation. It should be understood that the invention could be applied to any other type of raise boring tool 6 or equipment and the wear support assembly 4 could be positioned on any part of the reamer head 8 or drive stem 10 where wear protection and/or stability is required.

Figure 6:
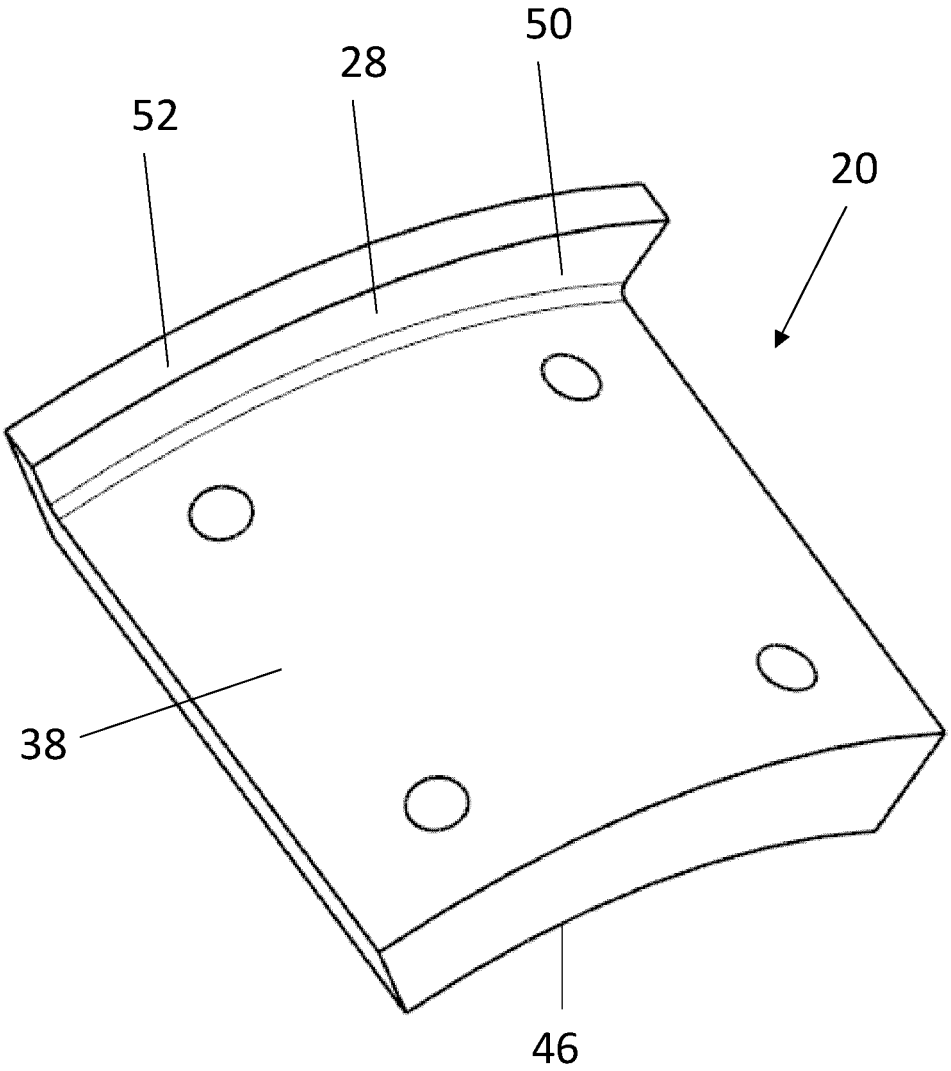
FIG. 6: Perspective view of the support plates with a back end step.

FIG. 6 shows that the support plate 20 could have a back end step 28, positioned to absorb force from the forward drilling direction and keep the wear pad 22 held rigidly in place. The backend step 28 is positioned on the axially opposite side of the support plate 20 compared to the roller cutters 14. The back end step 28 could be milled into the support plate 20 such that the support plate 20 is a one piece body. Alternatively, the back end step 28 could be bolted or welded onto the support plate 20, such that the support plate 20 is a two or more piece body. A step is section of the support plate 20 which has an increased thickness, with a first side 50 that is perpendicular to the upper surface 42 for abutment with the wear pad 22 and a second side 52 that is parallel and raised in respect to the upper surface 42.

Figure 7:
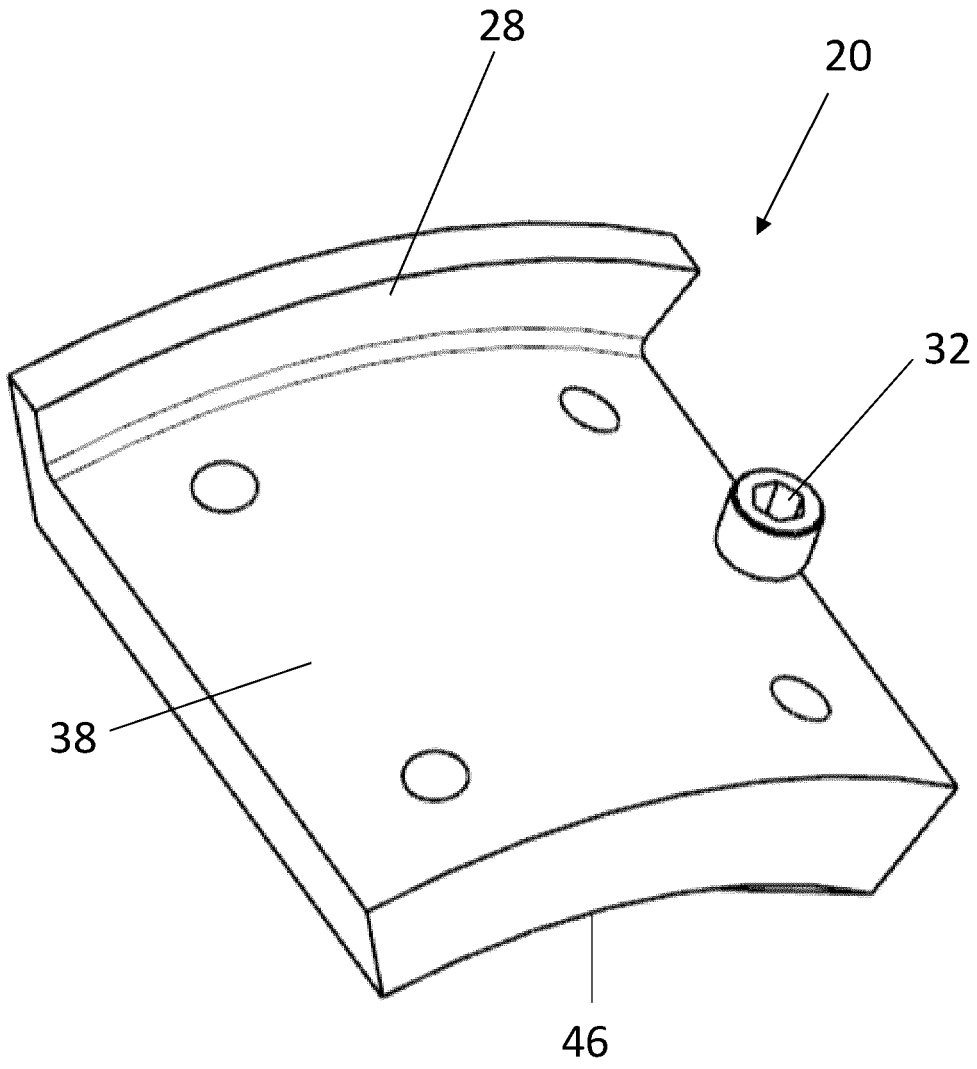
FIG. 7: Perspective view of an embodiment of the present invention wherein the support plate has a back end step and a stop bolt.

FIG. 7 shows that a stop bolt 32 could also be secured to the rotationally trailing side of the support plate 20, such that the wear pad 22 is able to press against it. The rotationally trailing side is the side that is opposite to the side that contacts the rock first as the reamer head 8 is rotating. The stop bolt 32 acts as a support for the wear pad 22 to absorb some of the rotational force applied from the drilling operation and aid in keeping the wear pad 22 held rigidly in place. The back end step 28 and the stop bolt 32 can either be employed on their own or in combination.

Figure 8:
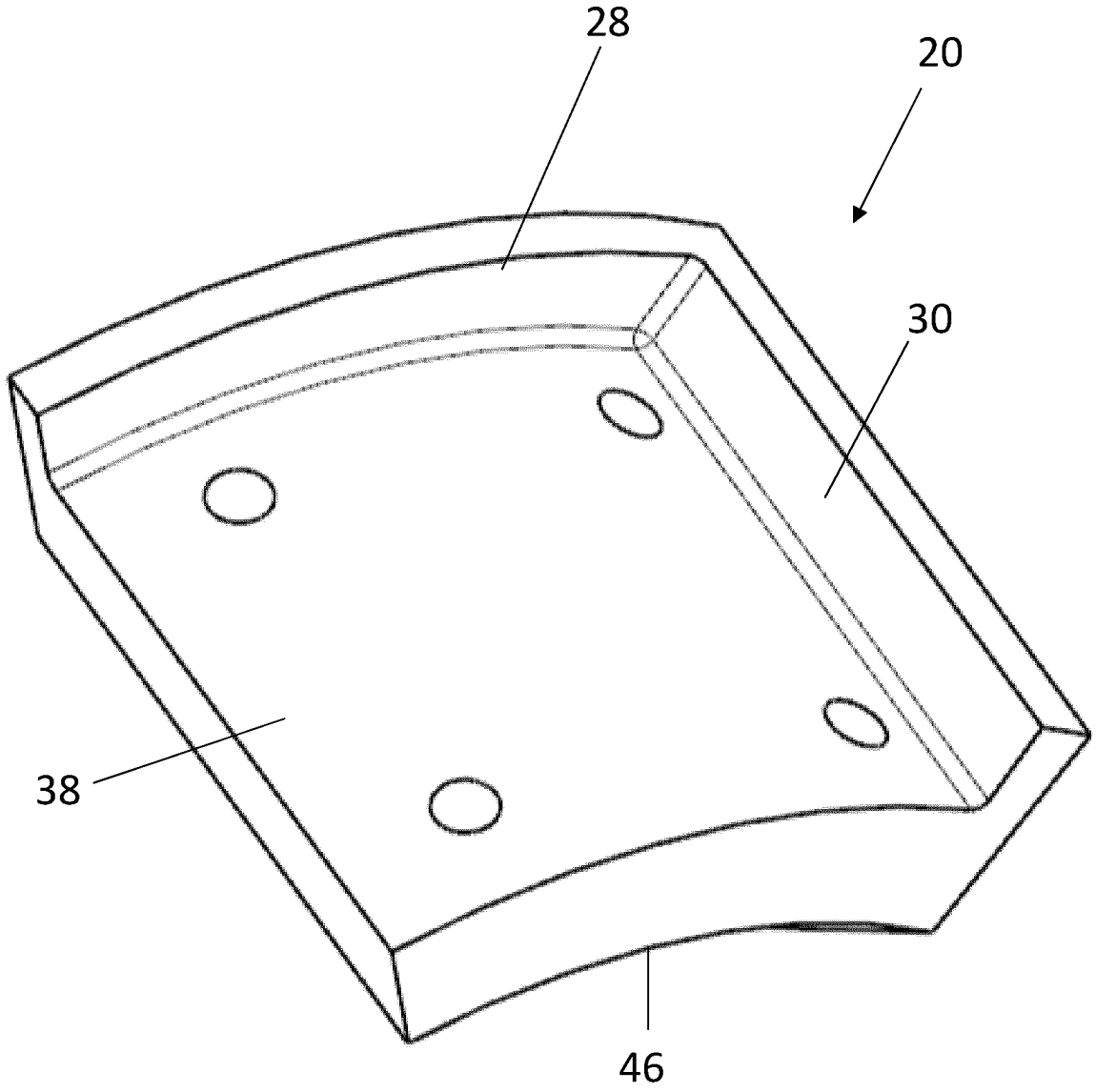
FIG. 8: Perspective view of an embodiment of the present invention wherein the support plate has a back end step and a side step.

FIG. 8 shows an alternative embodiment of the support plate 20, wherein the stop bolt 32 has been replaced with a side step 30. The side step 30 could be employed in combination with the back end step 28 or on its own. The side step 30 is positioned on the rotationally trailing of side of the support plate 20, in other words on the side of the support plate 20 that contacts the rock first as the reamer head 8 is rotating. Alternatively, the side step 30 could be positioned on the rotationally leading side of the support plate 20. There could also be two side steps 30 on the support plate 20, one of each side of the wear pad 22, in other words on both the rotationally trailing and rotationally leading sides, so that the wear pad 22 is supported in both rotational directions. The side step 30 could either be welded, milled or bolted in position. The side step 30 could be employed either on its own or in combination with a back end step 28.

A step is section of the support plate 20 which has an increased thickness, a first side 50 that is perpendicular to the upper surface 42 for abutment with the wear pad 22 and a raised side 52 that is parallel to the upper surface 42.

Figure 9:
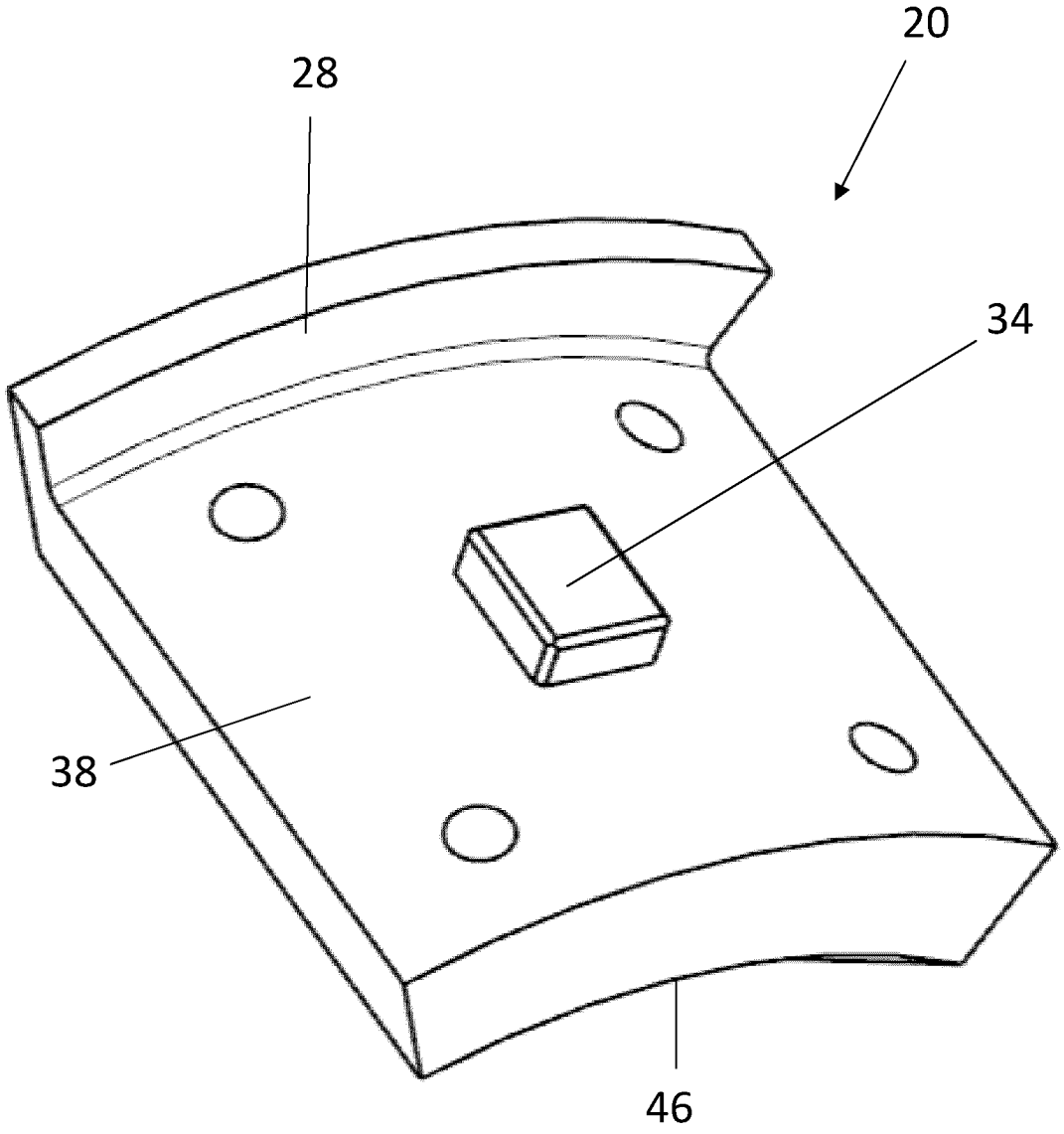
FIG. 9: Perspective view of an embodiment of the present invention wherein the support plate has a key.

FIG. 9 shows an alternative embodiment wherein there is a key 34 positioned on the support plate 20. The key 34 is fitted in a slot between the wear pad 22 and the support plate 20 to relieve the bolts 24 from stresses. The key 34 could be any suitable shape, for example in the form of a pin, oblong or half-moon. The key 34 could be pressed in place or bolted in place using small screws. The key 34 could be countersunk into a recess on the lower surface 40 of the wear pad 22. The key 34 could be used on its own or in combination with any of the previous embodiments disclosed hereinabove.

The upper surface 38 of the support plate 20 and the lower surface 40 of the wear pad 22 that are pressed against each other could either both be convex or curved, as shown in FIGS. 6-9.

Figure 10:
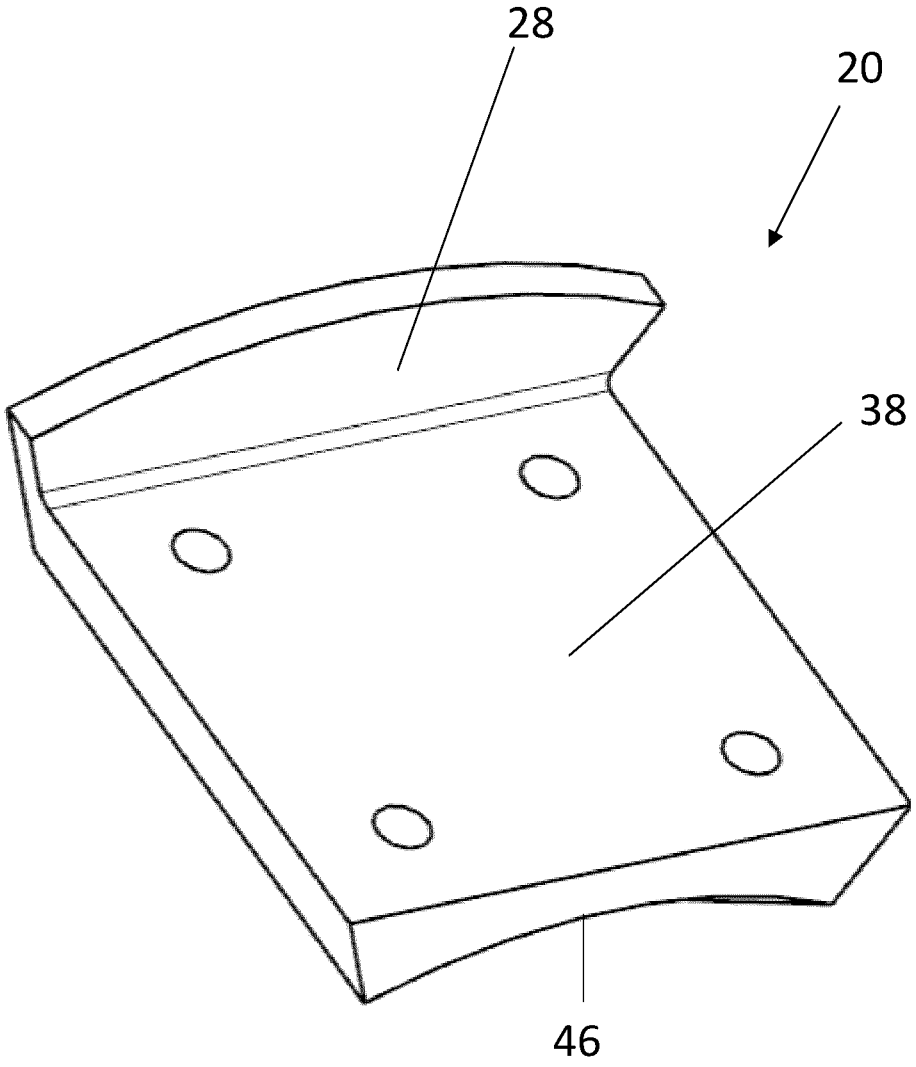
FIG. 10: Perspective view of an embodiment of the present invention wherein the support plate has a flat upper surface.

FIG. 10, shows an alternative embodiment, wherein the upper surface 38 of the support plate 20 and the lower surface 40 of the wear pad 22 are both flat and fitted so that they are parallel to one another.

The invention claimed is:

1. A wear support assembly associated with roller cutters of a raise boring tool, the wear support assembly comprising a wear pad arranged on top of a support plate, wherein the support plate has a lower surface for connecting to the raise boring tool, wherein the support plate includes a back end step for securing the wear pad to the support plate, the wear pad being rigidly held to the support plate and being arranged to provide support against forces applied from a forward drilling direction provided by the roller cutters, the backend step being positioned on an axially opposite side of the support plate as compared to the roller cutters, wherein the wear support assembly is arranged on a body of the tool between the roller cutters.

2. The wear support assembly according to claim 1, wherein the support plate has a stop bolt for securing the wear pad to the support plate.

3. The wear support assembly according to claim 1, wherein the support plate includes a side step for securing the wear pad to the support plate.

4. The wear support assembly according to claim 1, further comprising a key located on the support plate.

5. The wear support assembly according to claim 1, wherein the upper surface on the support plate and the lower surface on the wear pad are both flat.

6. The wear support assembly according to claim 1, wherein the upper surface on the support plate and the lower surface on the wear pad are both convex.

7. The wear support assembly according to claim 1, wherein the wear pad is hard faced with tungsten carbide.

8. A raise boring tool for raise boring operations comprising;

a reamer head having a body;

a plurality of roller cutters connected to the body by a holder;

a nose or drive stem connected to the body; and at least one wear support assembly according to claim 1, wherein each support plate is connected directly to the raise boring tool and each wear pad is bolted to each support plate.

9. The raise boring tool according to claim 8, wherein at least one wear support assembly is positioned on the nose of the reamer head.

10. The raise boring tool according claim 8, wherein at least one wear support assembly is positioned on the drive stem.

11. The raise boring tool according to claim 8, wherein the nose is integrated with the body.

12. The raise boring tool according to claim 8, wherein the nose is detachable from the body.

13. The wear support assembly according to claim 1, wherein both the wear pad and the support plate have at least one hole for receiving a bolt to connect the wear pad to the support plate.

14. The wear support assembly according to claim 13, wherein the at least one hole comprises two or more holes, each receiving a bolt.

15. The wear support assembly according to claim 13, wherein the at least one hole has two diameters, wherein a larger diameter is located nearer an upper surface of the support plate and a smaller diameter is located nearer a lower surface of the support plate.

* * * * *